United States Patent [19]

Gladek

[11] Patent Number: 4,869,024

[45] Date of Patent: Sep. 26, 1989

[54] ARRANGEMENT FOR TREATING THE RUNNING SURFACES BY SKIS

[75] Inventor: Janez Gladek, Hergiswil, Switzerland

[73] Assignee: Montana Sport GmbH, Hergiswil, Switzerland

[21] Appl. No.: 191,589

[22] Filed: May 9, 1988

[30] Foreign Application Priority Data

May 7, 1987 [AT] Austria ..... 1153/87

[51] Int. Cl.[4] ..... B24B 7/02

[52] U.S. Cl. ..... 51/92 R; 51/94 R; 51/124 R; 51/234

[58] Field of Search ..... 51/91 R, 92 R, 92 BS, 51/94 R, 96, 121, 122, 124 R, 143, 151, 157, 230, 231, 234

[56] References Cited

FOREIGN PATENT DOCUMENTS 26358 of 1911 United Kingdom ..... 51/91 R

*Primary Examiner*—Frederick R. Schmidt
*Assistant Examiner*—Maurina Rachuba
*Attorney, Agent, or Firm*—Toren, McGeady & Associates

[57] ABSTRACT

An arrangement for treating the running surfaces of skis, particularly for grinding the running coating and the steel edges of skis. The arrangement includes a rotating grinding member in the form of a grindstone or grinding belt. A rectilinear guide means extends parallel to the plane of rotation of the grinding member and is arranged above the grinding member. The guide means is capable of receiving and longitudinally displacing a support rail. The guide means is arranged on a support member which is vertically adjustable relative to the grinding member and is pivotable in the plane of the longitudinal extension of the guide means. Brackets are mounted on the underside of the support rail. The brackets are spaced apart from each other in longitudinal direction of the support rail. Holders for holding a ski to be treated are arranged on the brackets.

16 Claims, 4 Drawing Sheets

ARRANGEMENT FOR TREATING THE RUNNING SURFACES BY SKIS

BACKGROUND OF THE INVENTION

1. Field of the Invention

The present invention relates to an arrangement for treating the running surfaces of skis, particularly for grinding the running coating and the steel edges of skis. The arrangement includes a rotating grinding member in the form of a grindstone or grinding belt.

2. Description of the Prior Art

Arrangements of the above-described type are known. When skis are manufactured and serviced, conventional treatment procedures are the grinding of the ski running coating and of the steel edges, the beveling of the steel edges on the side of the running surface, the sharpening of the steel edges on the outer sides and also waxing of running surfaces. These treatment procedures utilize grinding belt machines, grindstone machines and grinding machines with grinding members of steel equipped with diamonds or cubic boron nitride. The treatment machines listed above are arranged in a chain for the production of skis and are connected to each other by means of automatic feeding units and conveyor belts.

If a ski is to be serviced, the above-described grinding procedures are difficult because a ski is then equipped with a binding and may frequently have near the front thereof a protecting device to prevent skis from crossing over each other.

Accordingly, the upper surface of the ski is not plane and the above-described treatment of the skis is difficult. In the past, this difficulty was overcome by placing a type of template on the upper surface of the ski. This template is an arc-shaped strip having the width of a ski. This strip is placed on the upper surface of the ski and extends in a bridge-like manner over the fittings which are screwed or glued to the ski surface, such as, bindings, cross-over protecting devices or the like. The strip then serves as a contact pressure and running surface for a feed roller.

However, the use of such a template in the treatment of used skis is disadvantageous for several reasons. The manipulation of the ski with the template is not safe because the template may slide off the ski surface. Pressure differences occur because of the different angles of incidence of the grinding member when the skis are manually guided. The feeding speed is also not constant. In addition, it is not possible to automate the treatment if several treatment steps are carried out.

German Auslegeschrift No. 2,204,216 describes and shows an arrangement for cutting a longitudinal profile in longitudinally moved workpieces, particularly for the manufacture of cores of skis of plastics material. The workpiece is a strip of plastics material which initially has a constant height over its entire length. In this prior art arrangement, the strip of plastics material is to be cut to a wedge-like longitudinal profile. The strip of plastics material is pressed by means of a pressure roller against a plane-milling cutter, wherein the distance of the pressure roller from the cutter is adjusted for producing a wedge-like longitudinal profile. A feeding device is used for advancing the strip of plastics material. This feeding device includes rollers which grip the strip of plastics material between them. A pressure roller exerts a vertical pressure against the strip of plastics material and presses the latter against the rotating workpiece.

The other rollers, on the other hand, have the purpose of exerting forces in the plane of the strip of plastics material and in its longitudinal direction in order to ensure its transport through the cutting tool. The strip of material is wound onto a supply drum or supply roller and the strip is pulled from the decelerated drum or roller. A guidance of the strip is not required because the strip cannot move to the side. Finally, it should be noted that German Auslegeschrift No. 2,204,216 does not show or describe a machine for the treatment of skis, but rather a cutting machine for the manufacture of a component part of a ski, i.e., a strip of plastics material which is wedge-shaped in the longitudinal direction and which serves as a component for the core of a ski.

Therefore, the primary object of the present invention to provide an arrangement for treating the running surfaces of skis which does not have the disadvantages of the arrangements described above.

SUMMARY OF THE INVENTION

In accordance with the present invention, a straight guide means extending parallel to the plane of rotation of the grinding member is arranged above the grinding member. The guide means is capable of receiving and longitudinally displacing a support rail. The guide means is arranged on a support member which is vertically adjustable relative to the grinding member and is pivotable in the plane of the longitudinal extension of the guide means. Brackets are mounted on the underside of the support rail. The brackets are spaced apart from each other in longitudinal direction of the support rail. Holders for holding the ski to be treated are arranged on the brackets.

The arrangement according to the present invention eliminates the disadvantages described above and, moreover, makes it possible to substantially eliminate the treatment procedures.

It is essentially possible to construct the guide means for the support rail as a sliding guide means. The guide means may also be formed by a plurality of rollers which are profiled on their circumference. The rollers are arranged in pairs and are rotatable essentially about vertically extending axes. The edges of the support rail have a profile which corresponds to the profile of the rollers, wherein the two profiles are capable of positively engaging in each other. As a result, the force required for advancing the support rail is reduced. In addition, if the rollers are driven rollers, the guide means can also be used as a feeding device.

In accordance with a feature of the present invention, the support member is formed by U-shaped, downwardly open, portal-type girders which are arranged in pairs and are spaced apart from each other. The free ends of the downwardly directed sides of these girders carry the rotatable rollers. This construction of the support member is particularly simple and is essentially open to all sides and, thus, the operation of the arrangement and the machine parts can be controlled without difficulties in this area.

In accordance with another feature of the present invention, a feed roller is provided between the girders. The feed roller presses the ski against the grinding member and advances the ski in its longitudinal direction. The feed roller is in frictional or positively locking engagement with the upper side of the support rail. In this case, the guidance and the feeding of the skis is carried out by different components. This separation of the functions makes it possible to have a support member of particularly simple construction.

In accordance with another development of the invention, a plane extending through the rollers is located outside of the circumferential circle of the feed roller. Also, the support member with the guide means is pivotable about the axis of rotation of the feed roller. As a result of these measures, the support rail is always in engagement with the feed roller independently of the respective angular position of the support rail relative to the horizontal.

The feed roller may be a gear wheel and the side of the support rail facing the feed roller may be a rack which meshes the gear wheel. This results in a positively locking engagement between the driving and driven components.

The distance of the first bracket seen in the travel direction of the support rail and the front end face of the support rail corresponds approximately to the length of the guide means. As a result, the support rail can be inserted in the guide means without the ski initially being in contact with the rotating tool.

The first bracket in travel direction of the support rail may have a contact surface which corresponds to the curvature of the front of the ski. The holders supported by the brackets may be U-shaped, downwardly open members extending transversely of the longitudinal direction of the support rail. The depth of the U-shaped holders is smaller than the thickness of that portion of the ski that is to be received by the respective holder. Accordingly, the underside or running surface of the ski protrudes downwardly beyond the sides of the holder. In addition, the U-shaped holders may be attached to the brackets by hinged connections. The brackets may be mounted on the support rail so as to be movable in longitudinal direction of the support rail. The above measures ensure that the ski to be treated is securely supported and that the support rail can be adapted in a simple manner to different length, shapes and contours of skis.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there are illustrated and described preferred embodiments of the invention.

DETAILED DESCRIPTION OF THE INVENTION

Figure 1:
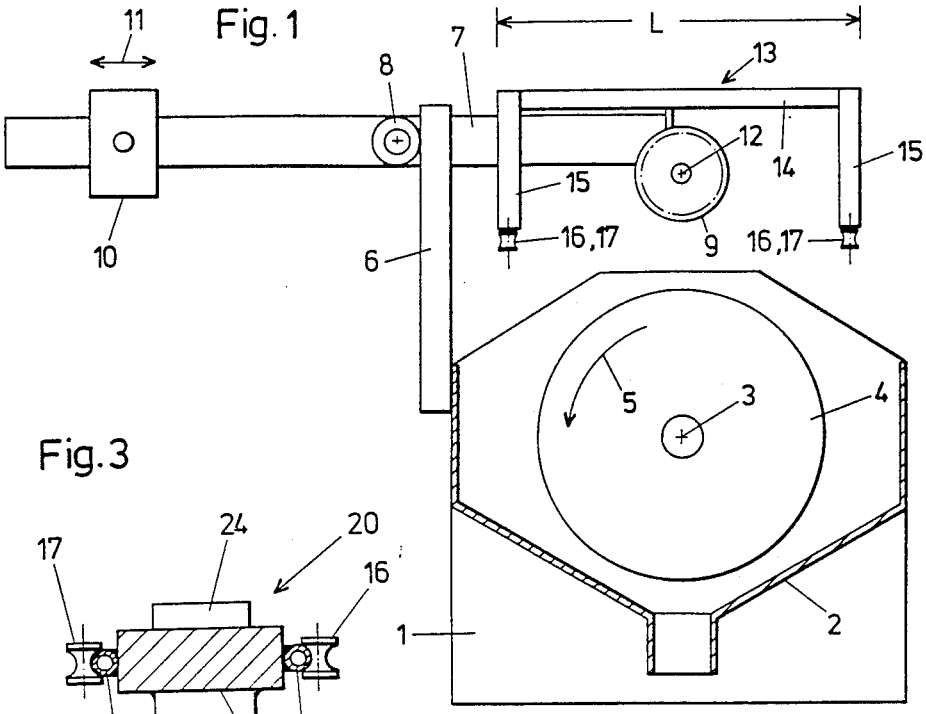
FIG. 1 is a schematic side view of the arrangement for treating the running surfaces of skis in accordance with the present invention.

The arrangement for grinding the running surface of a ski is schematically illustrated in a side view in FIG. 1 of the drawing. A stationary machine frame 1 includes a funnel-like insert 2 for wet grinding. A cylindrical grinding member 4 is mounted on a horizontal axis 3 so as to be rotatable in the direction of arrow 5. The grinding member 4 is driven by a motor, not shown. Instead of this cylindrical grinding member 4, a grinding belt guided on two guide rollers may also be used.

An upright support 6 attached to machine frame 1 supports a tilting member 7 which is tiltable about an axis 8 in a plane which extends parallel to the plane of the drawing of FIG. 1. Tilting member 7 supports a feed roller 9 and a drive motor, not shown, for feed roller 9. The tilting member 7 is constructed as a two-armed lever and has a weight 10 which is movable on the tilting member 7 as indicated by double arrow 11. By moving the weight 10, the force with which the feed roller 9 presses against the grinding member 4 can be adjusted. The axis 3 of the grinding member 4 and the axis 12 of the feed roller extends parallel to each other. The grinding member 4 and the feed roller 9 are essentially arranged in the same plane.

A support member 13 is pivotally mounted on the tilting member 7. Support member 13 extends over both sides of the feed roller 9. The support member 13 includes U-shaped, portal-like girders 14 which are arranged in pairs. Freely rotatable rollers 16 and 17 are mounted on the free ends of the downwardly directed sides 15 of the girders 14. In the illustrated embodiment, four rollers are provided, two rollers 16 being arranged in front of the feed roller 9 and two rollers 17 being arranged behind the feed roller 9, seen in a direction perpendicular to the drawing plane. All four rollers 16 and 17 are located in a plane and since the pivoting axis of the support member 13 coincides with the axis of rotation 12 of the feed roller 9, the normal spacing of the plane extending through the rollers 16 and 17 from the axis of rotation 12 is always the same independently of the respective angular position of support member 13. In addition, in the illustrated embodiment, the plane extending through the rollers 16 and 17 is located outside of the circumferential circle of the feed roller 9.

The support member 13 may be connected to a motor-driven adjusting device, not shown, which serves to control the angular position of the support member 13 relative to a plane or line of reference during the treatment operation. However, it is also possible to mount the support member 13 in a freely suspended manner, so that the movements of the support member 13 during the operation of the arrangement are controlled exclusively by the shape of the ski. When the ski is introduced into the arrangement, the curved front end of the ski makes contact with the grinding member and is then pressed upwardly together with the support member by the grinding member and may also be laterally pivoted.

The above-described freely rotatable rollers 16 and 17 form a straight-line guidance. Rollers 16 and 17 are profiled on their circumference. It is an advantage if the feed roller 9 is constructed as a gear wheel.

Figure 3:
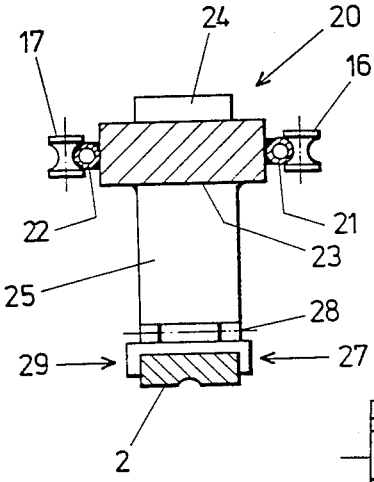
FIG. 3 is a sectional view taken along sectional lines III—III of FIG. 2.
Figure 2:
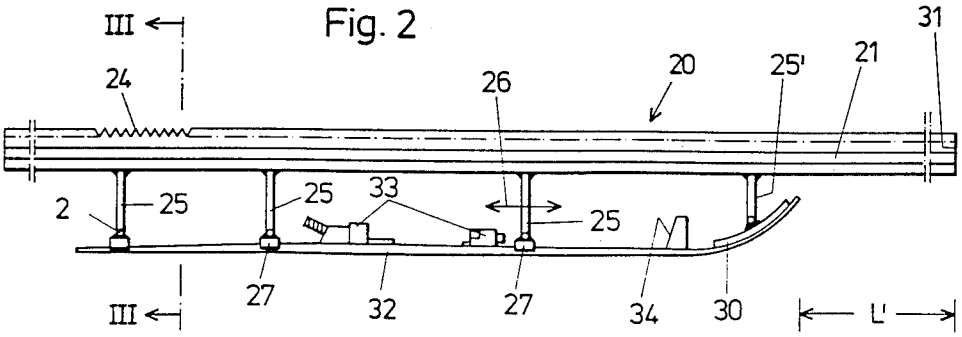
FIG. 2 is a side view of a support rail of the arrangement with a ski fastened to the support rail.

A support rail 20 interacts with the arrangement shown in FIG. 1. FIG. 2 is a side view and FIG. 3 is a cross-sectional view of the guide rail 20. Guide rail 20 includes two spaced-apart, rectilinear pipes 21 and 22 which extend parallel to each other and between which is arranged a plate-like strip 23 serving as a spacer member. The upper side of strip 23 is a rack 24.

Attached to the underside of strip 23 are brackets 25 which advantageously are movable in longitudinal direction of the support rail 20, as indicated by arrow 26. The brackets 25 are fixable in any position. U-shaped, downwardly open holders 27 are hinged about axis 28 to brackets 25. Clamping devices, indicated by arrows 29 in FIG. 3, are provided on the downwardly extending sides of the U-shaped holders 27. The clamping devices may be clamping screws, clamping jaws, clamping toggles or also hydraulically or pneumatically operated clamping cylinders. Instead of such mechanically operated clamping devices, it is also possible to provide suction cups as holders 27 which interact with the upper surface of the ski to be supported.

The first bracket 25 is provided with an arc-shaped holder 27 for receiving the curved front end of the ski. The distance L' of the first bracket 25 from the front end face 31 of the support rail 20 corresponds approximately to the length L of the guide means which is formed by the above-mentioned freely rotatable rollers 16 and 17.

If U-shaped, downwardly open holders 27 are used, the depth of these holders is slightly smaller than the thickness of the portion of the ski 32 to be received by the holder, so that the ski slightly protrudes beyond the holder 27, as can be seen in FIG. 3.

Figure 8:
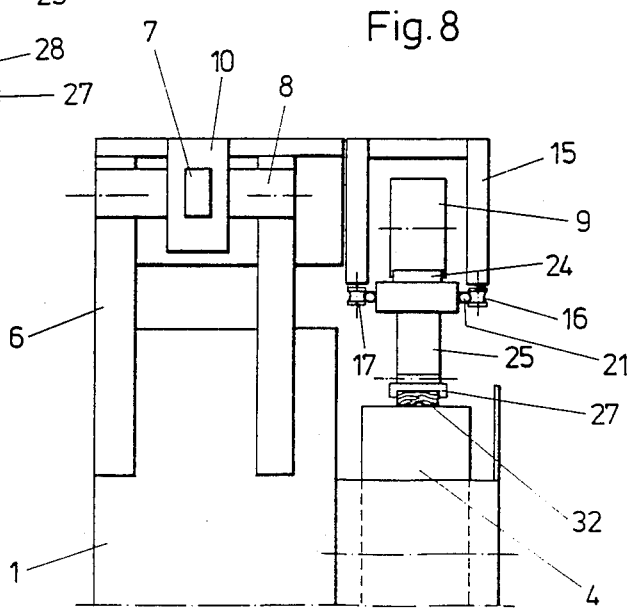
FIG. 8 is a schematic front view of the arrangement according to the present invention.

In the illustrated embodiment, the support rail 20 has on its sides pipes 21 and 22 of circular cross-section. As can be seen in FIGS. 3 and 8, rollers 16 and 17 of support member 13 have corresponding grooves, so that the support rail 20 can be engaged in a form locking manners by rollers 16 and 17.

Although, in the embodiment illustrated in the drawing, the guide means for the support rail 20 are the rollers 16 and 17 which are freely rotatably mounted on the support member 13, it should be noted that this guide means can also be a sliding guide means. In that case, profiled sliding ledges or sliding shoes are provided on support member 13 which interact with side parts of the support rail 20 having a corresponding cross-section.

FIG. 2 further shows that the fittings of the ski, i.e., binding 33, cross-over protecting device 34, are bridged by the support rail 20. In the illustrated embodiment, the support rail is rectilinear.

Figure 4:
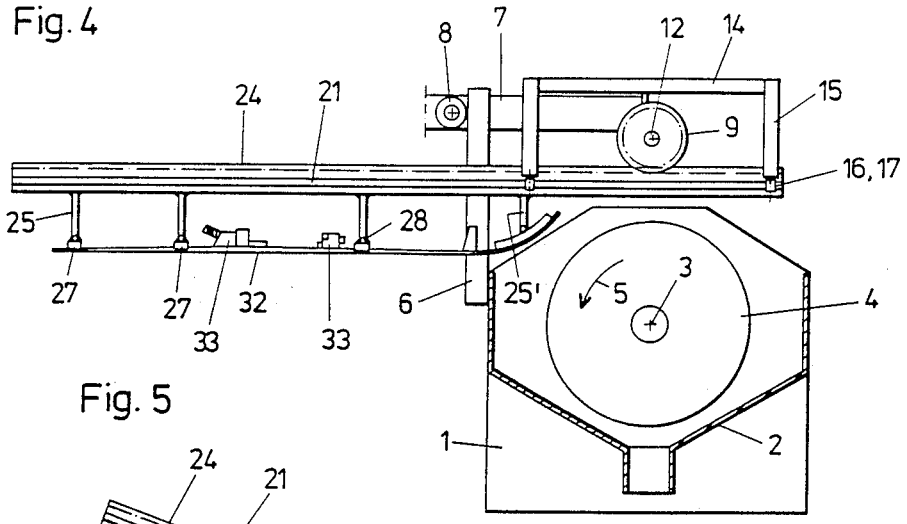
FIGS. 4, 5, 6 and 7 are side views of the arrangement according to the present invention, showing different stages of the passage of a ski through the arrangement.
Figure 5:
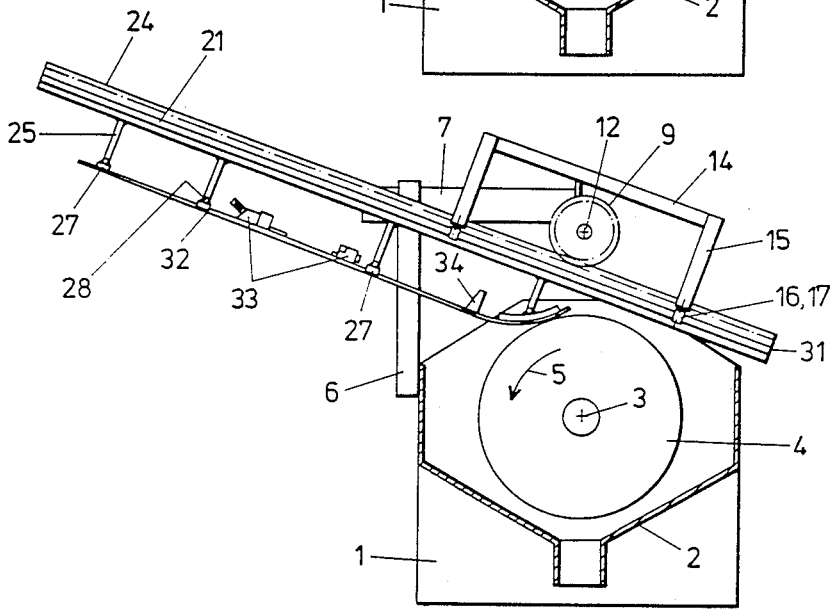
Figure 6:
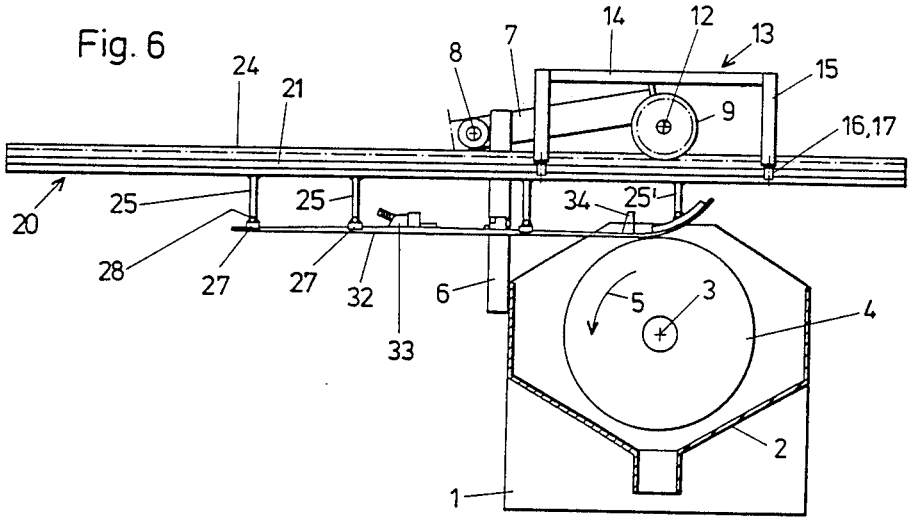

If a used ski 32 on which fittings 33, 34 are already mounted is to be serviced, i.e., its running surfaces are to be ground, the ski 32 is fastened on the holders 27 of the support rail 20, as shown in FIG. 2. Since the holders 27 are longitudinally movably mounted on the support rail 20, as indicated by arrow 26, the support rail and its brackets 25 can be adjusted to all ski sizes. However, the forward portion of the support rail 20 as indicated by length L', remains free. This free portion of the support rail 20 is then inserted in the guide means formed by rollers 16 and 17, as shown in FIG. 4. The feed roller 9 constructed as a gear wheel engages the rack 24 on the top side of support rail 20 and gradually pulls the support rail 20 together with the ski 32 fastened to the support rail 20 into the guide means. By means of switches, microswitches, light barriers, not shown, the support rail simultaneously activates the control unit for the support member 13, so that the support member 13, together with the support rail 20 received by support member, is slightly pivoted in a clockwise direction, as shown in FIG. 5, and the ski is gradually placed with its bent front portion onto the grinding member 4, as can be seen in FIG. 6.

Figure 7:
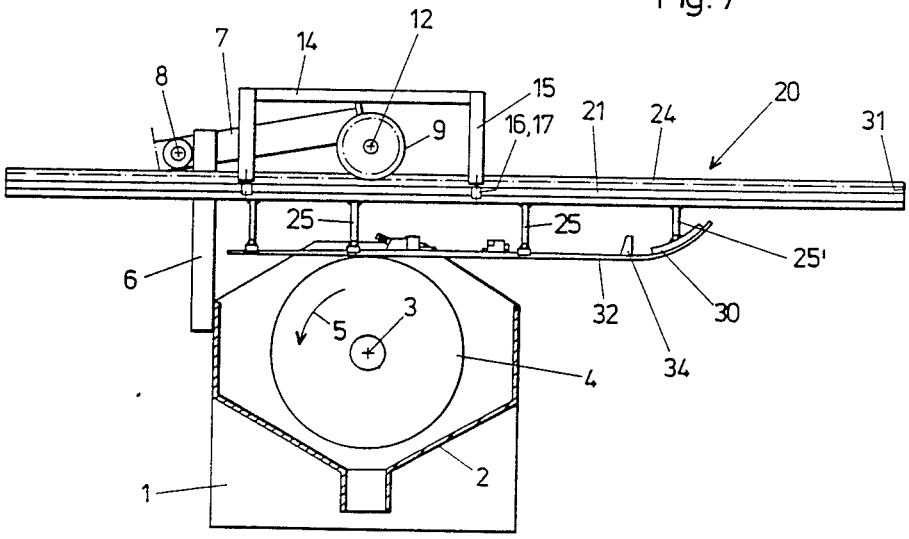

As illustrated in FIG. 7, the support rail 20 with the ski 32 fastened thereto is now gradually pivoted by support member 13 in a counterclockwise direction into its horizontal position and the ski is now pulled along grinding member 4, with the contact pressure between the ski and the grinding member 4 being adjusted by the weight 10. When the end of the ski is reached, the arrangement can be controlled in such a way that the feed roller 9 reverses its direction of rotation and returns the ski once again along grinding member 4. This forward and backward motion can be repeated until the running surfaces of the ski have the desired qualities.

Although, in the illustrated embodiment, the support rail 20 is provided on its sides with pipes 21 and 22 of circular cross-sections and the guide rollers 16 and 17 have a corresponding grooved cross-section, it should be noted that other profile shapes can be used which facilitate a positively locking engagement. The support rail 20 may also be constructed so that it can be pulled or pushed through the guide means. Instead of freely rotatable rollers 16 and 17, sliding members can also be provided as guide means.

In the illustrated embodiment, the feed roller 9 is a gear wheel and the upper side of the support rail 20 is provided with a rack. However, it would also be possible to provide an exclusive frictional engagement between the two components.

Additional driven grinding members may be provided on the downwardly extending sides 15 of the girder 14. Each of the additional grinding members has an axis of rotation which is essentially parallel to the longitudinal direction of the sides 15 and is provided for treating the outer sides of the steel edges of the ski 32 as the ski is passed through the arrangement. These additional driven grinding members are not illustrated in the drawing.

Figure 9:
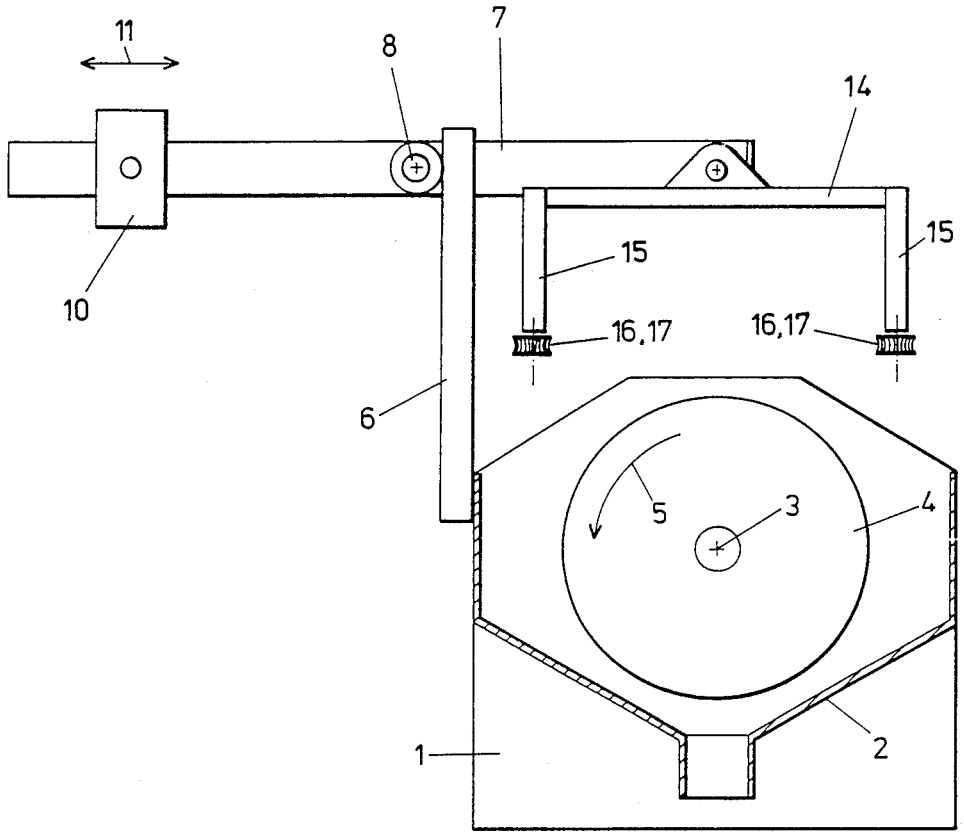
FIG. 9 is a side view of another embodiment of the arrangement according to the present invention.

The embodiment illustrated in FIG. 9 differs from the embodiment discussed above in that no feed roller 9 is provided. All other components are denoted by the same reference numerals. In this embodiment, at least some of the rollers 16 and 17 of the guide means are driven for feeding the support rail 20. The rollers 16 and 17 are profiled, preferably with toothed surfaces, and the pipes 21 and 22 on the sides of the support rail 20 have a corresponding profile, so that these components engage each other in a positively locking manner for enabling the feeding of the support rail 20.

Although, in the two embodiments described above, the support member 13 is mounted suspended from a tilting member 7, it is also possible and within the scope of the invention to mount the support member 13 and, if applicable, the feed roller 9, on a vertically movable support structure.

As illustrated in FIG. 3, the holder 27 and the bracket 25 are connected through a hinge-type connection. Instead of this hinge-type connection, an elastic intermediate member in the form of a rubber-elastic ledge may be arranged which permits a certain mobility of the holder 27 relative to the bracket 25.

The arrangement according to the present invention overcomes the above-discussed disadvantages of known arrangements of this type. In addition, the treatment procedures can be automated to a significant extent.

While specific embodiments of the invention have been shown and described in detail to illustrate the application of the inventive principles, it will be understood that the invention may be embodied otherwise without departing from such principles.

I claim:

1. In an arrangement for treating a running surface of a ski having a running coating and steel edges by grinding the running coating and the steel edges of the running surface, the arrangement including a rotating grinding member having a plane of rotation and a support rail for supporting the ski, the improvement comprising as rectilinear guide means extending parallel to the plane of rotation of the grinding member, the guide means being arranged above the grinding member, the guide means being configured to receive and longitudinally displace the support rail, the support rail having an underside, the guide means being arranged on a support member which is vertically adjustable relative to the grinding member and is pivotable in a plane of longitudinal extension of the guide means, brackets being mounted on the underside of the support rail, the brackets being spaced apart from each other in longitudinal direction of the support rail, and holders for holding a ski to be treated being arranged on the brackets.

2. The arrangement according to claim 1, wherein the guide means comprises a plurality of rollers which are profiled on their circumference, the rollers being arranged in pairs and rotatable essentially about vertically extending axes, the support rail having edges, the edges having a profile which corresponds to the profile of the rollers, wherein the profiles of the rollers and of the edges are capable of positively engaging in each other.

3. The arrangement according to claim 2, wherein the rollers are driven rollers.

4. The arrangement according to claim 1, wherein the support member comprises U-shaped, downwardly open, portal-type girders which are arranged in pairs and are spaced apart from each other, the girders having downwardly directed sides having free ends, the free ends carrying the rotatable rollers.

5. The arrangement according to claim 4, comprising a feed roller mounted between the girders, the feed roller pressing the ski against the grinding member and advancing the ski in its longitudinal direction, the support rail having an upper side, the feed roller being in engagement with the upper side of the support rail.

6. The arrangement according to claim 5, wherein the engagement between the feed roller and the upper side of the support rail is a frictional engagement.

7. The arrangement according to claim 5, wherein the engagement between the feed roller and the upper side of the support rail is a positively locking engagement.

8. The arrangement according to claim 5, wherein the feed roller has a circumferential circle, a plane extending through the rollers being located outside of the circumferential circle of the feed roller.

9. The arrangement according to claim 5, wherein the support member is pivotable about the axis of rotation of the feed roller.

10. The arrangement according to claim 5, wherein the feed roller is a gear wheel, and the upper side of the support rail facing the feed roller includes a rack, wherein the gear wheel meshes with the rack.

11. The arrangement according to claim 1, wherein the support rail has a front end face, the distance of the first bracket in feeding direction of the support rail and the front end face of the support rail corresponding approximately to the length of the guide means.

12. The arrangement according to claim 1, wherein the first bracket in feeding direction of the support rail includes a contact surface which corresponds to the curvature of the front of the ski.

13. The arrangement according to claim 1, wherein the holders supported by the brackets are U-shaped, downwardly open members extending transversely of the longitudinal direction of the support rail, the depth of each U-shaped holder being smaller than the thickness of the portion of the ski being received by the holder, so that the running surface of the ski protrudes downwardly beyond the holder.

14. The arrangement according to claim 13, wherein the U-shaped holders are attached to the brackets by hinged connections.

15. The arrangement according to claim 1, wherein the brackets are mounted on the support rails so as to be movable in longitudinal direction of the support rail.

16. The arrangement according to claim 5, comprising a tilting member for supporting the support member for the guide means and the feed roller, the tilting member being pivotable about an axis extending parallel to the axis of rotation of the grinding member.

* * * * *